United States Patent [19]

Walde

[11] 4,187,753

[45] Feb. 12, 1980

[54] KNIFE DRUM FOR CROSS CUTTING MACHINES

[75] Inventor: Peter Walde, Dusseldorf, Fed. Rep. of Germany

[73] Assignee: Jagenberg Werke Aktiengesellschaft, Dusseldorf, Fed. Rep. of Germany

[21] Appl. No.: 938,181

[22] Filed: Aug. 30, 1978

[30] Foreign Application Priority Data

Sep. 15, 1977 [DE] Fed. Rep. of Germany ..... 2741560

[51] Int. Cl.[2] ..... B26D 1/36

[52] U.S. Cl. ..... 83/674; 83/698

[58] Field of Search ..... 83/674, 673, 698

[56] References Cited

U.S. PATENT DOCUMENTS

| | | | |
|---|---|---|---|
| 3,321,145 | 5/1967 | Gorman | 83/674 X |
| 3,527,123 | 9/1970 | Dovey | 83/698 X |
| 3,793,918 | 2/1974 | Huffman | 83/674 X |

*Primary Examiner*—Frank T. Yost

*Attorney, Agent, or Firm*—Sprung, Felfe, Horn, Lynch & Kramer

[57] ABSTRACT

A knife drum for a cross cutting machine comprises a drum having an axial groove and a knife inserted in the groove with one side abutting one side of the groove. The space formed between the knife and the other side of the groove defines a downwardly tapering groove wherein a plurality of round chocks are mounted and which are selectively positioned in the radial direction. The chocks have an arcuate cross section with the largest diameter greater than the smallest width of the tapered groove, whereby in response to the radial positioning thereof, the knife is alternatively clamped between the chocks and one side of the groove or released.

4 Claims, 1 Drawing Figure

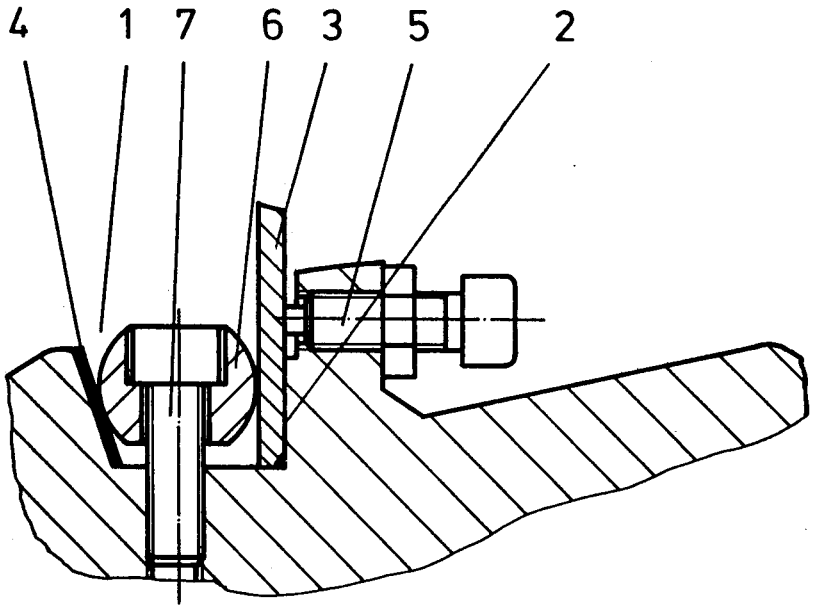
4
1
7
6
3
5
2

KNIFE DRUM FOR CROSS CUTTING MACHINES

BACKGROUND

The invention relates to a knife drum for cross cutting machines having a knife inserted into a tapered groove and fastened therein by means of chocks.

In a known knife drum of this kind, the chocks are of a tapered shape and consist of self-hardening steel. They are tightened in the groove by means of set screws, thus wedging the knife in place. Due to manufacturing tolerances, the clamping point between the knife and the block, and hence also the knife tightening force, is not precisely defined. In order nevertheless to fasten the knife securely in the groove, it is necessary accordingly to increase the gripping force. But since it is already difficult to loosen the blocks wedged into the groove for the purpose of changing the knife, a greater gripping force would only make knife changing more difficult.

THE INVENTION

The object of the invention is to create a knife drum for cross cutting machines, in which knife changing will be easier to perform.

This object is achieved in a knife drum for cross cutting machines of the kind described, by making the chocks round. The surface of the chocks is preferably hardened. Furthermore, the surface within the groove against which the chocks thrust can also be hardened.

The round chocks result in a number of advantages. Aside from the fact that they are easier and less expensive to manufacture than tapered chocks, they can be released without difficulty from the groove for knife changing. Since a precisely defined pressure line between the chock and the knife is produced, the tightening force that needs to be applied can be comparatively low.

BRIEF DESCRIPTION OF THE DRAWING

The invention will now be further explained with the aid of a FIGURE showing a detail of a cross sectional view of a knife drum.

DETAILED DESCRIPTION OF THE INVENTION

The knife drum has a groove 1 whose cross section tapers from top to bottom and which is disposed substantially axially of the drum, a knife 3 having parallel surfaces being in contact with the one side 2 of the groove, and the other side 4 of the groove being hardened. The knife 3 is supported in the upper portion thereof by set screws. With the knife 3 in place, the groove 1 tapers in cross section from top to bottom; this tapered shape could also be brought about, of course, by installing a knife having a cross section which tapers from its back to its edge instead of one having parallel sides.

The knife 3 is held tightly in groove 1 by one or more chocks 6 placed side by side, which are tightened in place by means of screws 7. The chocks 6 are of round cross section. Their surfaces are hardened. By tightening the screws 7, the chocks 6 are drawn into the groove 1, engaging the side 4 and exerting pressure along a line on knife 3. In this manner the knife 3 is held tightly. When the screws 7 are loosened, the chocks 6 come loose easily, since they need to be tightened to a lesser extent for the secure fastening of the knives 3 and they engage side 4 and knife 3 along precisely defined lines.

It will be appreciated that the instant specification and claims are set forth by way of illustration and not limitation, and that various changes and modifications may be made thereto without departing from the spirit and scope of the present invention.

What is claimed is:

1. A knife drum for a cross cutting machine and the like comprising: a drum having an axial groove; a knife inserted in the groove with one side abutting one side of the groove, wherein the space formed between the other side of the knife and the other side of the groove defines a downwardly tapering groove; and means for releasably clamping the knife in place comprising a plurality of round chocks mounted for selected positioning in the radial direction with respect to the drum and having an arcuate cross section with the largest diameter greater than the smallest width of the tapered groove, whereby in response to the radial positioning thereof, the knife is alternatively clamped between the chocks and the one side of the groove or released.

2. The knife drum according to claim 1, wherein the surface of each chock is hardened.

3. The knife drum according to claim 1, wherein the other side of the groove is hardened.

4. The knife drum according to claim 1, wherein the one side of the groove is perpendicular to the axis of the drum and the other side is disposed at an acute angle with respect thereto.

* * * * *